United States Patent [19]

Hallenius et al.

[11] 4,192,629

[45] Mar. 11, 1980

[54] SYSTEM FOR THE STORAGE OF RADIOACTIVE MATERIAL IN ROCK

[76] Inventors: Tore J. Hallenius, Tegelbruksgatan 93, 852 40 Sundsvall; Karl I. Sagefors, Klevstigen 22, 170 71 Öregrund, both of Sweden

[21] Appl. No.: 857,041

[22] Filed: Dec. 2, 1977

[30] Foreign Application Priority Data

Dec. 13, 1976 [SE] Sweden ..... 7613996
Jan. 19, 1977 [SE] Sweden ..... 7700552
Mar. 2, 1977 [SE] Sweden ..... 7702310

[51] Int. Cl.[2] ..... G21F 7/00; E02D 29/00
[52] U.S. Cl. ..... 405/128; 252/301.1 W
[58] Field of Search ..... 252/301.1 W; 61/0.5; 405/128; 52/169.6

[56] References Cited

U.S. PATENT DOCUMENTS 3,925,992 12/1975 Backstrom ..... 61/0.5
3,996,751 12/1976 Hallenius et al. ..... 61/0.5

OTHER PUBLICATIONS

Quieser, H., "Treatment of Radioactive Slurry and Storage of Concentrated Waste," *Nuclear Engineering Int'l*, Feb. 1975, pp. 108–110.

*Primary Examiner*—Benjamin R. Padgett
*Assistant Examiner*—Deborah L. Kyle
*Attorney, Agent, or Firm*—LeBlanc, Nolan, Shur & Nies

[57] ABSTRACT

An underground repository for the storage of radioactive material, particularly spent fuel from nuclear reactors and radioactive wastes produced by reprocessing spent nuclear fuel. The repository comprises a hollow body of solid material for accommodating the radioactive material. The hollow body is surrounded by a shell or barrier of clay. The hollow body and the clay barrier are located in a cavity in rock, the clay filling the space between the hollow body and the inside of the rock cavity.

17 Claims, 9 Drawing Figures

SYSTEM FOR THE STORAGE OF RADIOACTIVE MATERIAL IN ROCK

The invention relates to a system for the storage of radioactive material in rock and more particularly to a repository for the long-term storage of spent fuel from nuclear reactors and radioactive waste that is produced by reprocessing used nuclear fuel.

The fuel elements of a nuclear reactor must be removed after some time and replaced by new fuel. The spent fuel contains uranium, plutonium and fission products. The uranium and plutonium can be recovered by a reprocessing operation and used again as fuel. However, the present methods of reprocessing do not allow the recovery of all uranium and plutonium, and in the reprocessing operation a waste is produced which in addition to a large number of fission products also contains small amounts of uranium and plutonium and other transuranic elements. Most of the wastes are highly radioactive and disintegrate under gradual transformation into stable elements. During the disintegration radiation of different kind is emitted. The disintegration rate of different wastes is highly different and may vary from fractions of seconds to millions of years. Plutonium-242 e.g. has a half-life of 380,000 years.

Since intense radioactive radiation is dangerous to living organisms it is necessary to store this high-level waste during a long period (thousands of years) in such a way that it is kept isolated from all life.

In the reprocessing operation the high-level waste is separated in the form of an aqueous solution which is concentrated as much as possible. However, this solution is not suited for final storage, and after a certain cooling period it is therefore converted into solid form. It is thought that the best method of converting the waste to solid form is to vitrify the waste. This means that the waste solution is evaporated and calcinated and then heated to a suitable temperature with an addition of glass making substances. By this process a fused glass mass is obtained which is filled into containers or canisters. These canisters are then placed in a suitable repository.

It has been proposed that the solidified high-level waste should be finally stored in rock cavities located at a great depth in bedrock. One proposed storage system of this kind consists of a receiving station located on the ground surface for receiving the waste. A vertical transport tunnel is bored from this receiving station to a great depth into the bedrock, and from the bottom part of this vertical tunnel a horizontal transport tunnel is extended in the bottom of which is taken up a number of vertical holes. By means of automatic transport vehicles the waste canisters are transported through said tunnels and are lowered like plugs into the vertical holes in the bottom of the horizontal tunnel. As the holes are filled with waste canisters they are sealed at the top e.g. with concrete.

Such a repository provides an effective screening of the radioactive radiation. However, the bedrock does not constitute any homogenous material but usually contains crevices and cavities and often contains ground water. The rock may also be subjected to deformations e.g. by earth quakes. Also, for various reasons the bedrock may undergo slowly proceeding deformations. In a repository of the kind described above there is a risk that such deformations of the rock may cause the breaking of the waste canisters stored in the rock.

Also there is a risk that ground water comes into contact with the radioactive waste which may thereby be dispersed in an uncontrollable manner. The radioactive disintegration also generates heat which gives rise to convection currents in the ground water. The radioactive radiation may also cause a chemical disintegration, so called radiolysis, of material exposed to the radiation. The radiolysis makes the surrounding water attain a much higher content of oxygen than ordinary water whereby the water becomes highly corrosive so that there is a risk that the casing of the radioactive waste will corrode away leaving the waste in direct contact with the ground water.

The object of the present invention is to provide a system for the storage of radioactive material in rock in which the abovementioned hazards are eliminated. Thus, the invention relates to a repository fulfilling the following requirements:

(1) It shall not be possible for the radioactive material to come into contact with ground water and to be spread by this.

(2) It shall not be possible for the radioactive material to escape into the environment due to deformations of the rock, e.g. deformations caused by seismic activity (earth quakes).

(3) The heat generated by the disintegration of the radioactive material shall be dissipated without any dangerous rise in temperature in the environment.

The repository of this invention is primarily intended for the final storage of the radioactive waste produced by reprocessing spent nuclear fuel. However, the repository of the invention could also be used for the interim storage of spent nuclear fuel before this is reprocessed. The repository of the invention namely permits the material stored therein to be easily removed if so desired.

The repository of the invention comprises a hollow body of a solid material the interior of which constitutes a space for the accommodation of the radioactive material. This hollow body is placed in an inner cavity in the rock, said cavity having larger dimensions than the hollow body which is so situated in this cavity that its outer side is everywhere spaced from the sides of the cavity. The space between the hollow body and the sides of the inner cavity is filled with a plastically deformable material. In the rock outside the inner cavity there may be excavated an outer cavity surrounding the inner cavity on all sides and being also filled with a plastically deformable material.

The hollow body is preferably made of concrete and has an ellipsoid-like or spherical shape. Hereby the hollow body attains a very high resistivity against the action of external forces.

The plastically deformable material surrounding the hollow body and filling the outer cavity preferably is clay. Clay is particularly suited for this purpose because it is capable of absorbing ions, has a small permability to water and can be deformed without cracking due to its plasticity.

The rack mass between the inner and the outer cavity will be wholly embedded by the plastically deformable material. This material may have a sufficient supporting capacity to prevent the rock mass from sinking in it, but to make sure that such sinking shall not occur it may be advisable to stabilize the material by the addition of some suitable stabilizing agent in the area under the rock mass.

Other objects and features of the invention will become apparent from the following description with reference to the accompanying drawings which show preferred embodiments of the invention.

Figure 1:
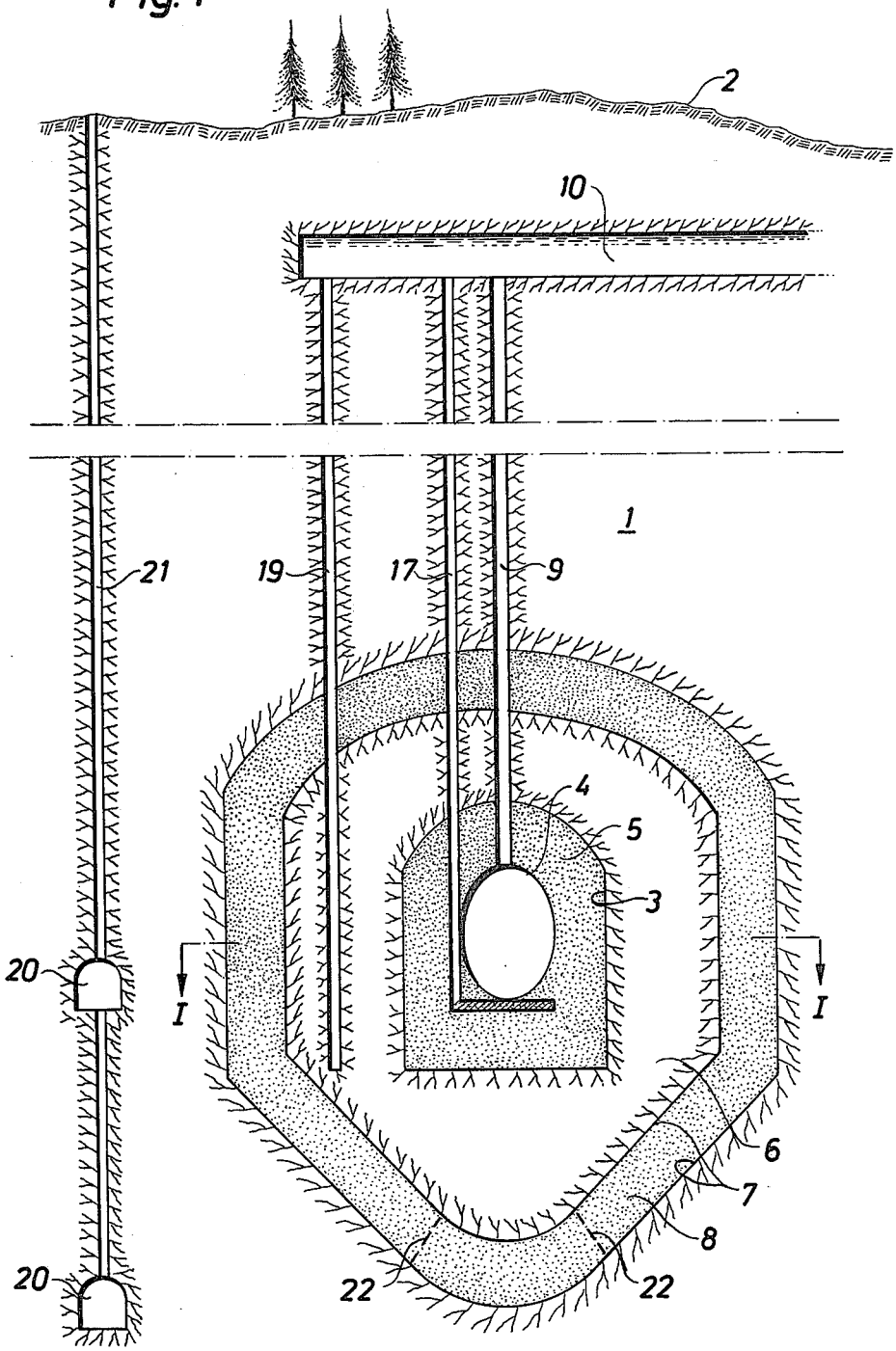
FIG. 1 shows a vertical section of a repository in accordance with a first embodiment of the invention.
Figure 2:
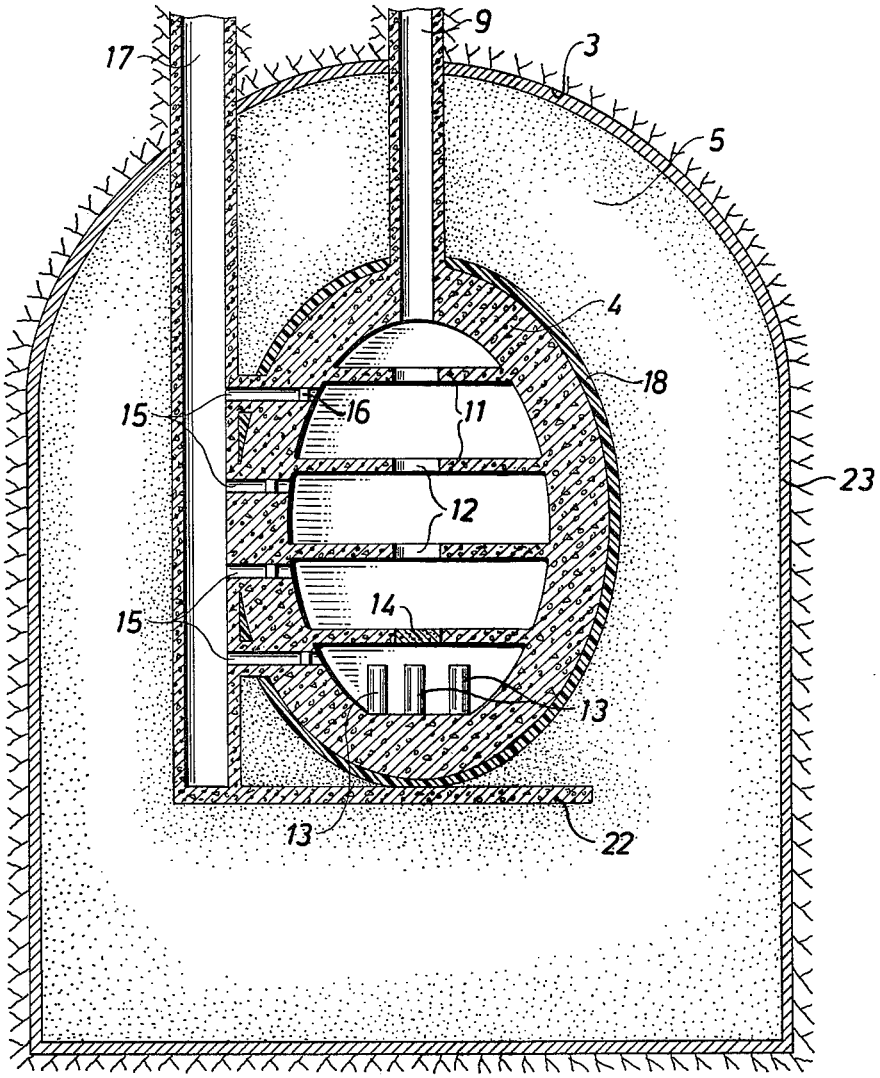
FIG. 2 shows on a larger scale and in section the inner cavity and the hollow body located therein.
Figure 3:
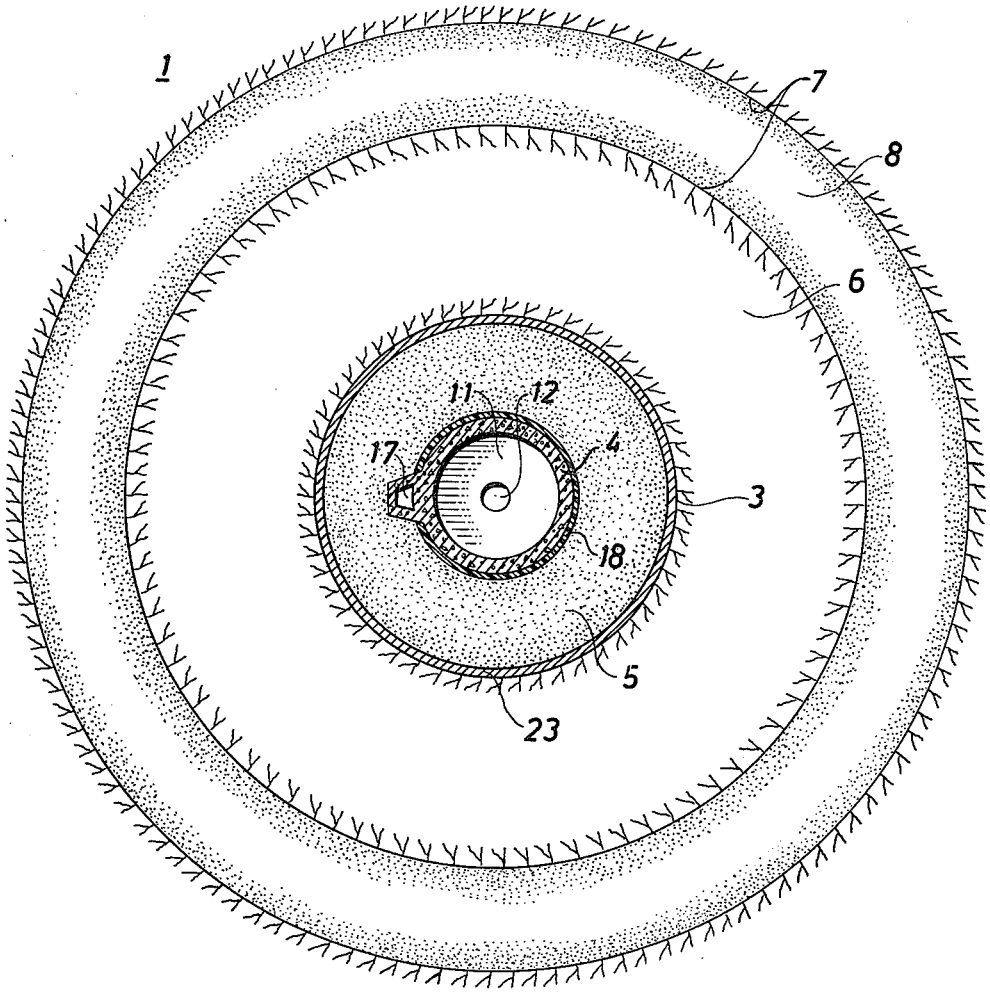
FIG. 3 shows a section taken along line I—I in FIG. 1.

Referring now to FIGS. 1–3 numeral 1 designates the bedrock in which the repository is situated at a certain depth under the ground surface 2. In the rock is excavated an inner cavity the outline of which is designated 3. A hollow body 4 which is made of concrete and the interior of which constitutes the space for accommodating the radioactive material is placed within the cavity 3 in such manner that the outside of the concrete body 4 everywhere is spaced from the wall of the cavity 3. The space between the wall of cavity 3 and the concrete body 4 is filled with clay 5.

The cavity 3 is wholly surrounded by rock mass 6 and this is surrounded by an outer cavity the boundary lines of which are designated 7. The outer cavity 7 is also filled with clay 8.

The cavities 3 and 7 as seen in a horizontal section preferably have a circular form. The boundary walls 7 of the outer cavity as seen in a horizontal section taken along line I—I in FIG. 1 thus form two concentric circles as shown in FIG. 3.

The concrete body 4 which has an ellipsoidal form is provided with an opening at its top which is in communication with a horizontal tunnel 10 through a shaft 9. Through the tunnel 10 and the shaft 9 the radioactive material can be transported into the hollow concrete body 4. In FIG. 2 the hollow concrete body 4 is shown in section. Its interior is divided by means of horizontal partitions 11 into several apartments located above each other. The partitions 11 are provided with openings 12 which are situated straight under the bottom opening of shaft 9. The radioactive material is successively introduced into these apartments beginning with the bottom one. In FIG. 2 some containers 13 for the radioactive waste are shown in the bottom apartment. When the whole volume of an apartment is fully utilized, the opening 12 can be closed with a lid 14 or be permanently sealed.

As shown in FIG. 2 the concrete body 4 is at one side provided with inspection openings 15 into which are fitted windows 16 of lead glass. The openings 15 open into a shaft 17 which extends upwards to the horizontal tunnel 10 (FIG. 1). Supervision personnel can be hoisted down through the shaft 17 to inspect visually the interior of the concrete body 4. The supervision can also be effected by means of a television system having cameras placed in the openings 15 and monitors placed at a supervision site remote from the repository.

The outside of the concrete body 4 may be covered with a layer 18 of plastics which is heat insulating and water tight. The plastics layer 18 may be provided with cooling channels for the circulation of a suitable coolant.

The inner cavity 3 may also be provided with a layer 23 of a heat insulating material on its walls.

A vertical shaft or boring 19 extends through the rock mass 6 up to the horizontal tunnel 10. In the shaft 19 are mounted measuring devices (not shown) for the measurement of temperature, moisture and radioactive radiation. These measuring devices may be connected through wires in shaft 9 and tunnel 10 with indicating means at a supervision site.

Drainage tunnels 20 may be provided in the bedrock outside the repository extending circularly around the repository. The object of these drainage tunnels 20 is to lead away ground water that my exist in the bedrock outside the repository. A boring 21 extends from the drainage tunnels 20 to the ground surface.

The horizontal tunnel 10 shown in FIG. 1 may communicate directly with a plant for reprocessing spent nuclear fuel. Herby the hazards accompanying a transport of radioactive wastes are decreased. However, the tunnel 10 is not essential to the system of the invention. Thus, the shafts 9, 17, and 19 may open into some suitable building for the reception of the radioactive waste. This building may be situated on the ground surface or in a cavity in the rock.

The system is of course provided with suitable hoisting and transport means for the transport of the radioactive wastes through the shaft 9 and distribution of the wastes in the space within the concrete body 4. Such hoisting and transport means which are preferably remote controlled could be designed according to known techniques and will not be described more in particular.

The construction of the system can be effected by the use of wellknown methods of rock excavation. At first working and transport tunnels are driven in the rock to the places where the two cavities are to be located. The excavation of the two cavities will take place from below and upwards. The outer cavity 7 is filled with clay as the rock mass is removed. The clay is compressed so that no cavities will remain in it. In an area situated at the bottom of the outer cavity the clay could be stabilized by the addition of a suitable stabilizing agent to be capable of supporting more safely the load of the rock mass 6. Such a stabilized area is indicated in FIG. 1 by dotted lines 22. When the inner cavity 3 is excavated, clay is placed on the bottom of the cavity up to a certain height. Then the hollow concrete body and the connecting shafts 9 and 17 are cast. When the concrete has hardented and the insulating plastics layer 18 been placed on the outside of the concrete body, the space between the concrete body and the walls of the inner cavity is wholly filled with clay. When the structure is completed the said working and transport tunnels may be filled with concrete.

Cracks and fissures that may be present in the rock adjacent to the two cavities could be sealed by injection of concrete.

The repository according to the invention can be said to consist of a plurality of shells of different material arranged within each other, namely in the embodiment shown in FIGS. 1–3, an innermost concrete shell 4, a first shell 5 of clay, a shell 6 consisting of rock mass, and a second shell 8 of clay which is wholly surrounded by the rock.

If displacements and subsidences should occur in the rock outside the repository these movements of the rock will first cause a deformation of the outer clay shell 8. If this clay shell is sufficiently thick the deformation forces will not be transferred to the inner shells. If the deformations should be of such magnitude that even the shell 6 of rock is affected, the deformation forces will be further damped by the inner clay shell 5. The innermost concrete shell 4 which has preferably an ellipsoidal or spherical form has a very high resistivity against pressure forces acting from the outside. Therefore, not even very extensive deformations, e.g. deformations caused by earth quakes, can affect the system to such extent that even the innermost concrete shell 4 collapses.

Figure 4:
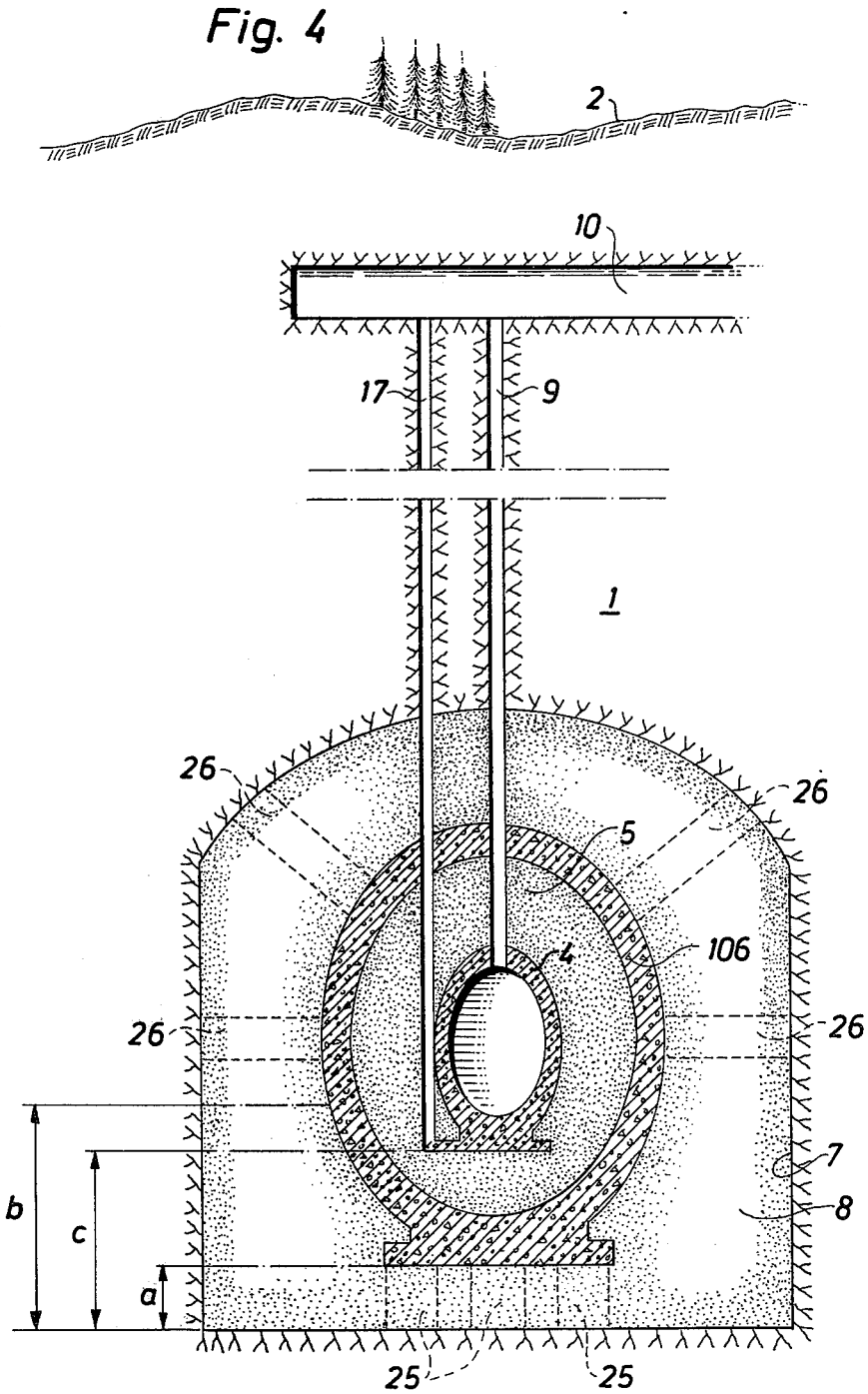
FIG. 4 shows a vertical section of a repository according to a second embodiment of the invention.
Figure 5:
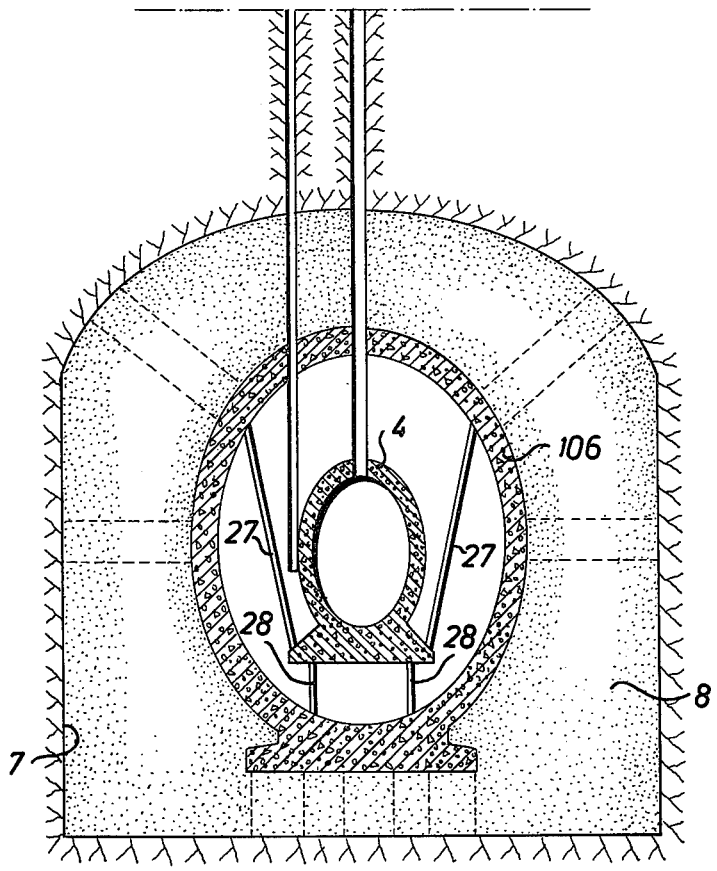
FIG. 5 shows a similar embodiment having supporting means for supporting the hollow body within a concrete shell.

FIGS. 4 and 5 show embodiments which differ from that shown in FIGS. 1–3 by the shell 6 of rock shown in FIGS. 1 and 3 being replaced by a shell 106 of concrete which is preferably reinforced. Also the form of the outer cavity 7 in the embodiments shown in FIGS. 4 and 5 is somewhat different from the form of cavity 7 shown in FIG. 1.

The concrete shell or body 106 has preferably an ellipsoidal (egg-like) form whereby it can best resist the action of external forces. The term "ellipsoidal form" also covers a purely spherical form, since a sphere can be considered as a special case of an ellipsoid. Even other forms, e.g. cylindrical, are possible for the shell 106. The thickness of the shell is dependent of the total size of the system and may for instance amount to some meters. The bottom part of shell 106 is preferably formed with a plane horizontal surface.

The concrete shell 106 and the parts enclosed therein, namely the clay shell 5 and the hollow body 4 with its content of radioactive material, have a considerable weight, and this weight is to be supported by that part of the plastically deformable material 8 which is located between the bottom portion of shell 106 and the bottom of the cavity 7. The plastically deformable material may have a sufficient supporting capacity to prevent the shell 106 with its contents from sinking towards the bottom of the cavity 7, but to make sure that such sinking shall not occur it may be advisable to provide supporting means in the plastically deformable material 8 under the shell 106. Such supporting means are indicated by dotted lines and designated 25 in FIG. 4. Similar supporting means 26 may also be provided at the center of shell 106 and even higher up as shown in the figure. The supporting means 25 and 26 are preferably made of a material which has a very large compressive strength but is somewhat elastic. Such a material is hard rubber. The supporting means 25 and 26 preferably are in the form of rods having e.g. circular cross-section. This supporting means stabilize the position of shell 106 within the cavity 7. The supporting means 25 may also consist of pillars of rock remaining after the excavation of the cavity 7.

The construction of the system shown in FIG. 4 can be effected by the use of wellknown methods of rock excavation and concrete casting. At first working and transport tunnels are driven into the rock to the place where the cavity 7 is to be situated, and this cavity is excavated. The the cavity 7 is filled with clay or other plastically deformable material up to a certain level above the bottom of the cavity. Then the construction of the concrete shell 106 is begun. This shell is built up in stages. In a first stage the shell is built up to a level b, and clay or other plastically deformable material is filled outside the shell up to this level. Within the shell 106 clay is filled up to the level c, and within this clay layer the hollow body 4 is built up. The construction of shell 106 then continues in further stages, and as the construction proceeds, clay or other plastically deformable material is filled both within the shell around the hollow body 4 and outside the shell in the space between the outside of the shell and the wall of the cavity 7. If supporting means 25 are to be used these are placed at their respective sites before the filling of the clay.

The hollow body 4 can be positioned within the concrete shell 106 by means of supporting means designed and arranged in similar manner as the supporting means 25 and 26 between the concrete shell 106 and the wall of the cavity 7.

FIG. 5 illustrates another way of positioning the hollow body 4 within the shell 106. Here the hollow body 4 is suspended by stays or wires 27 and 28 which may be made of steel. One end of each stay 27 and 28 is anchored in known manner in the body 4 and the other end is anchored in the concrete shell 106.

If the space between the hollow body 4 and the concrete shell 106 is filled with a plastically deformable material, e.g. clay, this material will exert a pressure on all sides of the hollow body 4. The force resultant from this pressure is directed upwards. As long as the hollow body 4 is empty or filled only in part with radioactive material this force may be larger than the weight of the body. The stays 28 anchored in the bottom of body 4 then prevent the body 4 from moving upwards. When the hollow body is filled to a certain part, the resultant force will strive to move the body downwards. Such movement is prevented by the upwards extending stays 27.

Since the stays 27 and 28 alone maintain the hollow body 4 in correct position within the shell 106 so that the body 4 is everywhere spaced from the inside of shell 106, the filling of plastically deformable material in the space between the body 4 and the shell 106 can be omitted, and this space can be filled with air.

Figure 6:
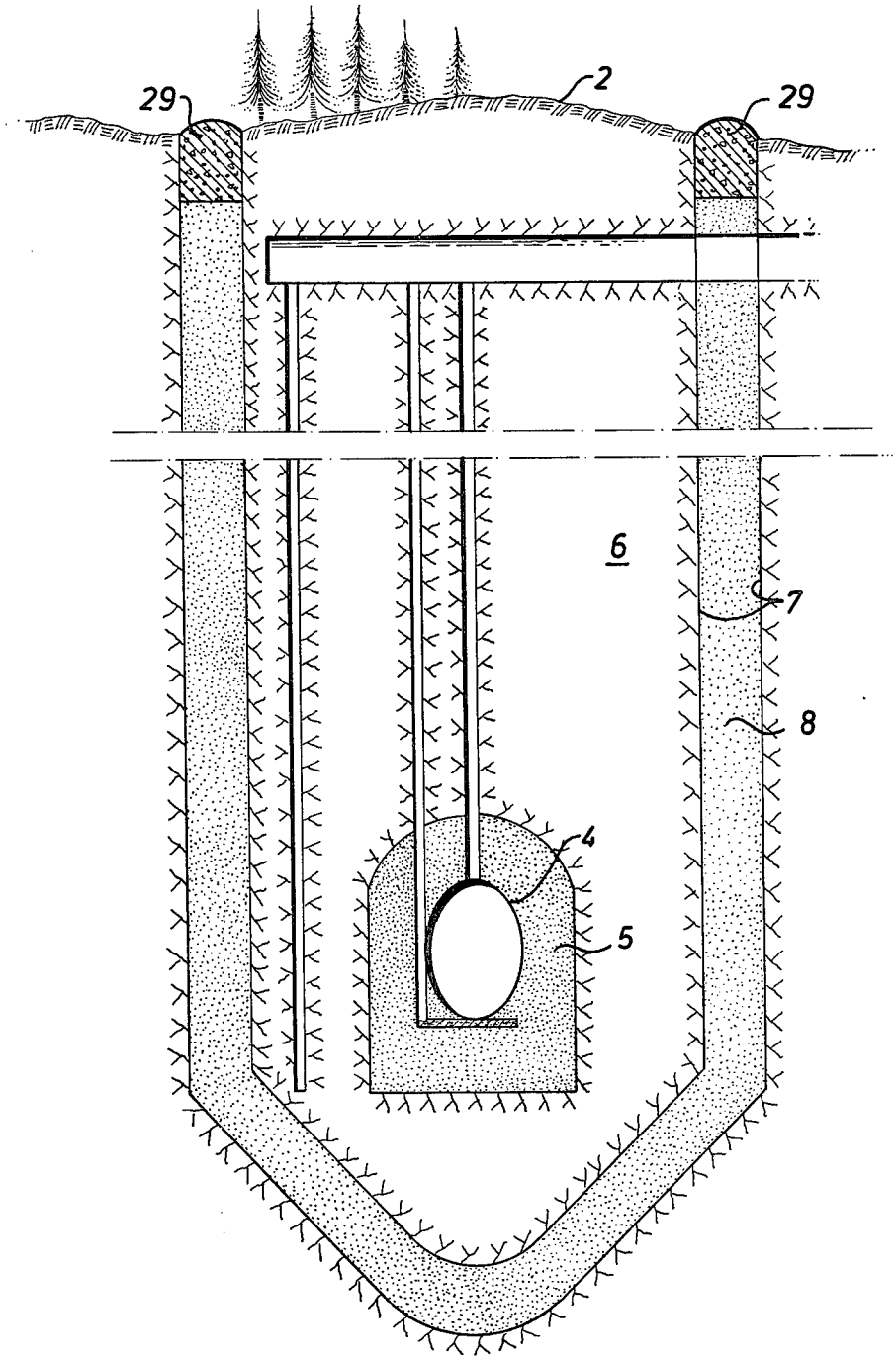
FIG. 6 shows a vertical section of a modification of the embodiment shown in FIGS. 1–3.

The embodiment shown in FIG. 6 differs from the embodiment shown in FIGS. 1–3 only in that the outer cavity the boundary walls of which are designated 7 extends up to the ground surface 2. seen in horizontal section the cavity 7 has preferably the form of an annulus. Thus, the plastically deformable material 8, e.g. clay, which fills this cavity has the form of a cylindrical or tube shaped shell which is terminated by a conical bottom. This tube shaped shell of plastically deformable material 8 surrounds a core 6 of rock mass. The outside of the shell 8 is also surrounded by rock. At the ground surface the cavity 7 is sealed with a layer of concrete 29. The concrete layer 29 prevents precipitation from penetrating the plastically deformable material 8. The concrete layer 29 is made sufficiently thick to prevent deliberate damage to the system e.g. through actions of war. The top side of the concrete layer could be rounded convexly as shown in the figure so that missiles hitting the concrete layer will rebound away from it.

The embodiment shown in FIG. 6 is particularly suitable if the ground water level in the surrounding rock is high. The core 6 of rock mass which is located inside the clay shell 8 can be drained so that it becomes free from ground water, and the clay shell 8 effectively prevents ground water in the outer rock from penetrating into the system.

Other parts shown in FIG. 6 can be designed in the same manner as the corresponding parts of the embodiment described with reference to FIGS. 1–3 and will not be described in particular.

Figure 7:
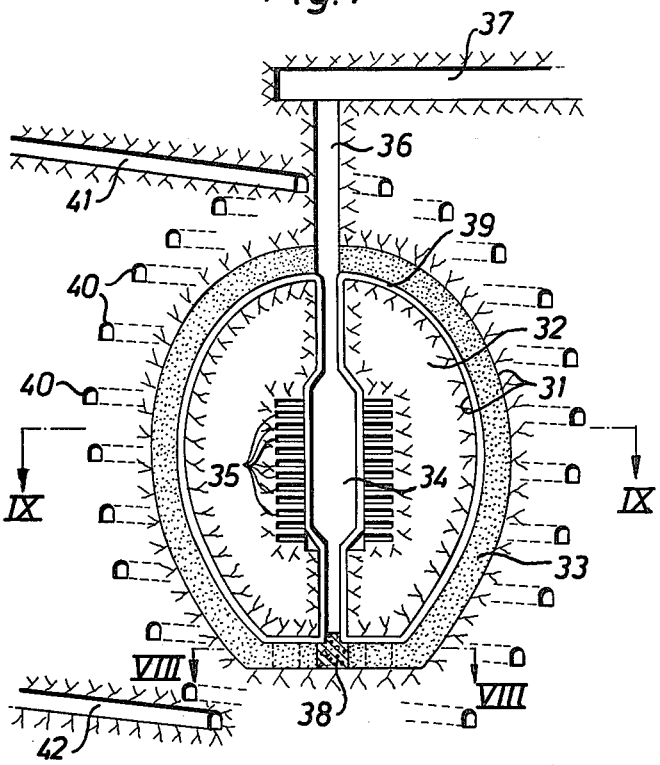
FIG. 7 shows a vertical section of another embodiment of the invention.
Figure 8:
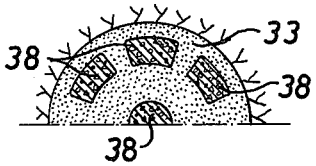
FIG. 8 shows a half horizontal section taken along line VIII—VIII in FIG. 7.
Figure 9:
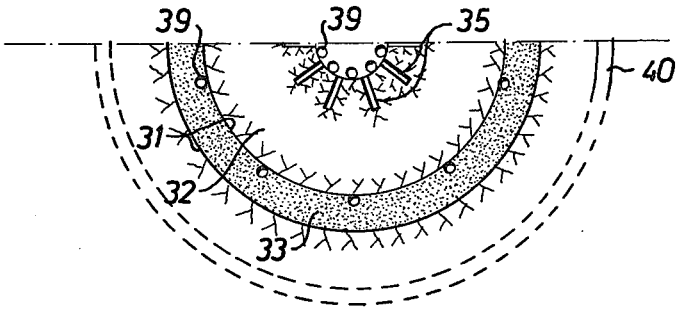
FIG. 9 shows a half horizontal section taken along line IX—IX in FIG. 7.

FIGS. 7 to 9 show another embodiment of the invention in which there is provided only one layer or shell of plastically deformable material (e.g. clay) around the inner hollow body.

The repository shown in FIGS. 7–9 is assumed to be situated in a rock formation at a suitable depth, e.g. 300 to 600 meters below the ground surface.

In the rock is excavated a cavity the walls of which are designated 31. This cavity is so excavated that a core 32 of rock mass remains in its interior. The space between this core and the outer rock is filled with a plastically deformable material 33, e.g. clay.

In the core 32 is excavated an inner cavity 34 which has the form of a cylinder with a vertical axis. The walls of cavity 34 are provided with a large number of recesses 35 which extend radially from the cavity into the core 32. The recesses 35 are intended to form storage spaces for the radioactive material. If this material consists of fuel rods containing spent but not reprocessed nuclear fuel, the form of the recesses 34 is adapted to the form of these fuel rods, so that a fuel rod can be inserted in each recess 35. However, in the first hand the repository is to be used for the storage of the radioactive waste that is produced by reprocessing spent nuclear fuel. Such waste is converted by known methods to solid form, e.g. by vitrifying, and is filled in containers which preferably have an oblong cylindrical form. The storage spaces 35 can be adapted to the form of these waste containers. Thus, the recesses 35 are preferably arranged in groups which are placed above each other, the recesses of each group extending radially outwards from the inside of the cavity 34 with equal angular spacing as seen in FIGS. 7 and 9.

The cavity 34 communicates through a vertical shaft 36 with a horizontal tunnel 37. Through tunnel 37 and shaft 36 the radioactive material is transported into the cavity 34. The repository is of course provided with suitable hoisting and transport means for transporting the radioactive material through shaft 36 and for distributing the waste in the recesses 35. These hoisting and transport devices which are preferably remote controlled may be of a kind well known in the art and will not be described more in particular.

The core 32 is supported at its bottom by concrete pillars 38 which rest upon the rock outside the shell 33 of clay. The form and arrangement of these pillars is most clearly seen in FIG. 8.

The repository is provided with an inner cooling system which consists of a plurality of conduits 39 containing a suitable coolant which is preferably water. Each conduit 38 forms a closed loop which is situated in a vertical plane and which extends along the inner wall of cavity 34 and along the outside of the core. In that part of the cooling loop 39 which is situated in the cavity 34, the coolant will be heated by the heat developed by the radioactive material in the recesses 35, and therefore the coolant is caused to circulate around the loop 39 and is cooled at the outside of core 32 where the temperature is lower.

The repository is also provided with an outer cooling system which consists of a tunnel which extends in a helix having a plurality of turns concentrically with the whole system and along its whole height. The helix-shaped part 40 of this tunnel is connected at the top to a tunnel 41 for the removal of hot coolant and connected at the bottom to a tunnel 42 for the supply of cooler coolant. At some distance from the system the tunnels 41 and 42 are connected to each other (not shown in the drawing) so that a closed cooling system is formed which likewise operates according to the thermosiphon principle.

Cracks and crevices that may be present in the rock core 32 are sealed by injection of some suitable sealing material, e.g. sodium silicate which as time goes on is converted into silicium dioxide.

The construction of this repository can likewise be effected by the use of well known methods of rock excavation. At first working and transport tunnels are driven in the rock to the place where the cavity 35 is to be located. The excavation of the cavity will take place from below and upwards. The cavity is filled with clay as the rock mass is removed. Before the cavity is filled with clay in its bottom part the concrete pillars 38 are cast.

If the repository is to be used for the final storage of radioactive waste, e.g. such waste that is produced in reprocessing spent nuclear fuel, the whole repository can be sealed when all recesses 35 are filled with radioactive waste. This sealing can be effected by filling the cavity 34, the shaft 36 and the tunnel 37 wholly or in part with clay or other suitable material.

The dimensions of the repository may of course vary within wide limits. The core 32 can e.g. have a largest diameter of 25 meters and a height of 60 meters, and the shell 33 of clay can have a thickness of 6 meters. These dimensions are given only by way of example and the invention is of course not restricted to these dimensions.

It is not necessary to locate the repository according to this invention at a very large depth. Thus, the repository could be located above the ground water level and even in less stable rock formations. It is also possible to locate the repository according to the invention in mountains rising above the surrounding ground.

Thus, a repository constructed according to this invention will make possible a safe storage of radioactive waste during a time period sufficiently long to allow the radioactive radiation to decrease to a harmless level.

However, it will be understood that a repository in accordance with this invention can also be used for the disposal of other materials than radioactive material.

We claim:

1. An underground repository for the storage of radioactive material and other materials in a rock formation, comprising a first cavity in said rock formation, a first body of rock derived from said rock formation by having been left at the excavation of said first cavity so as to be located within said first cavity and spaced on all sides from the walls of said first cavity, the space between said first body of rock and the walls of said first cavity being filled with a plastically deformable material supporting said first body of rock in said spaced relationship relative the walls of said first cavity, said first body of rock being hollow and containing in its interior storage space for the material to be stored, and shaft means extending through said rock formation, said space filled with said plastically deformable material and said first body of rock to said storage space for the transfer of the material to be stored into said storage space.

2. A repository as claimed in claim 1, wherein said first body of rock has a substantially ellipsoidal form.

3. A repository as claimed in claim 1, wherein said plastically deformable material is clay.

4. A repository as claimed in claim 1, wherein said first cavity is extended up to the ground level of said rock formation.

5. A repository as claimed in claim 4, wherein said first cavity is sealed with concrete at the ground level.

6. A repository as claimed in claim 1, comprising a second cavity within said first body of rock, said second cavity serving, at least partially, as said storage space.

7. A repository as claimed in claim 6, wherein the walls of said second cavity are provided with recesses forming said storage space.

8. A repository as claimed in claim 7, in which said second cavity is substantially cylindrical with a substantially vertical axis, said recesses extending substantially radially outwards from the cylindrical wall of said second cavity.

9. A repository as claimed in claim 1, comprising a cooling system including a plurality of closed conduit loops for the circulation of a coolant, each of said conduit loops having a first part extending through the interior of said first body of rock between the lower part and the upper part thereof and a second part extending outside said first body of rock in said space between said first body of rock and the walls of said first cavity.

10. A repository as claimed in claim 1, wherein said plastically deformable material is stabilized in the lower portion of said space.

11. A repository as claimed in claim 1, comprising a second cavity located within said first body of rock, a second body of a solid material disposed within said second cavity so as to be spaced on all sides from the walls of said second cavity, said second body being hollow and containing said storage space in its interior, said shaft means extending into the interior of said second body so as to communicate with said storage space therein.

12. A repository as claimed in claim 11, wherein said second body is made of concrete.

13. A repository as claimed in claim 11, wherein said second body has a substantially ellipsoidal form.

14. A repository as claimed in claim 11, wherein the space between said second body and the walls of said second cavity is filled with air and stay means are connected between said second body and the walls of said second cavity to suspend said second body in said spaced relationship relative the walls of said second cavity.

15. A repository as claimed in claim 11, wherein the space between said second body and the wall of said second cavity is filled with a plastically deformable material supporting said second body in said spaced relationship relative the walls of said second cavity.

16. A repository as claimed in claim 15, wherein said plastically deformable material is clay.

17. A repository as claimed in claim 11, wherein said second hollow body contains several internal storage compartments vertically spaced within said second body and separated from each other by horizontal partition walls provided with openings for the transfer of the material to be stored into said storage compartments.

* * * * *